US005869930A

United States Patent [19]

Baumberg et al.

[11] Patent Number: 5,869,930

[45] Date of Patent: Feb. 9, 1999

[54] ELECTROLUMINESCENT LIGHT SOURCE WITH A MIXTURE LAYER FILLED WITH A TRANSPARENT FILLER SUBSTANCE

[75] Inventors: Israel Baumberg, Maale Adumim; Joseph S. Bodenheimer, Jerusalem; Joseph Dvir, Mevasseret Zion; Moses Voskoboinik, Maale Adumim, all of Israel

[73] Assignee: Elam-Electroluminescent Industries Ltd., Jerusalem, Israel

[21] Appl. No.: 736,021

[22] Filed: Oct. 22, 1996

[51] Int. Cl.[6] ..... H01J 1/62

[52] U.S. Cl. ..... 313/506; 313/511; 313/509; 428/917

[58] Field of Search ..... 313/498, 506, 313/509, 511, 512, 502, 505; 428/917, 690; 315/169.3

[56] References Cited

U.S. PATENT DOCUMENTS

| | | | |
|---|---|---|---|
| 3,819,973 | 6/1974 | Hosford | 313/498 |
| 5,469,020 | 11/1995 | Herrick | 313/511 |
| 5,485,355 | 1/1996 | Voskoboinik et al. | 313/511 |

FOREIGN PATENT DOCUMENTS

| | | |
|---|---|---|
| 3742412 | 12/1987 | Germany . |
| 4342264 | 12/1993 | Germany . |
| 9715939 | 5/1997 | WIPO . |
| 9724015 | 7/1997 | WIPO . |

*Primary Examiner*—Jay M. Patidar
*Attorney, Agent, or Firm*—Schweitzer Cornman Gross & Bondell LLP

[57] ABSTRACT

There is provided a light source consisting of at least one flexible, cable-like electroluminescent filament, each filament having a central electrode (2) surrounded by an electrically insulating dielectric layer (4), and a layer (6) consisting of a mixture of an electroluminophor powder and a binder. The mixture is applied to the dielectric layer (4). The light source also includes a transparent electrode (8) surrounding the mixture layer (6). Pores formed in the mixture layer (6) are filled in by a transparent filler substance. A method for preparing the light source is also provided.

17 Claims, 6 Drawing Sheets

FIG. 3
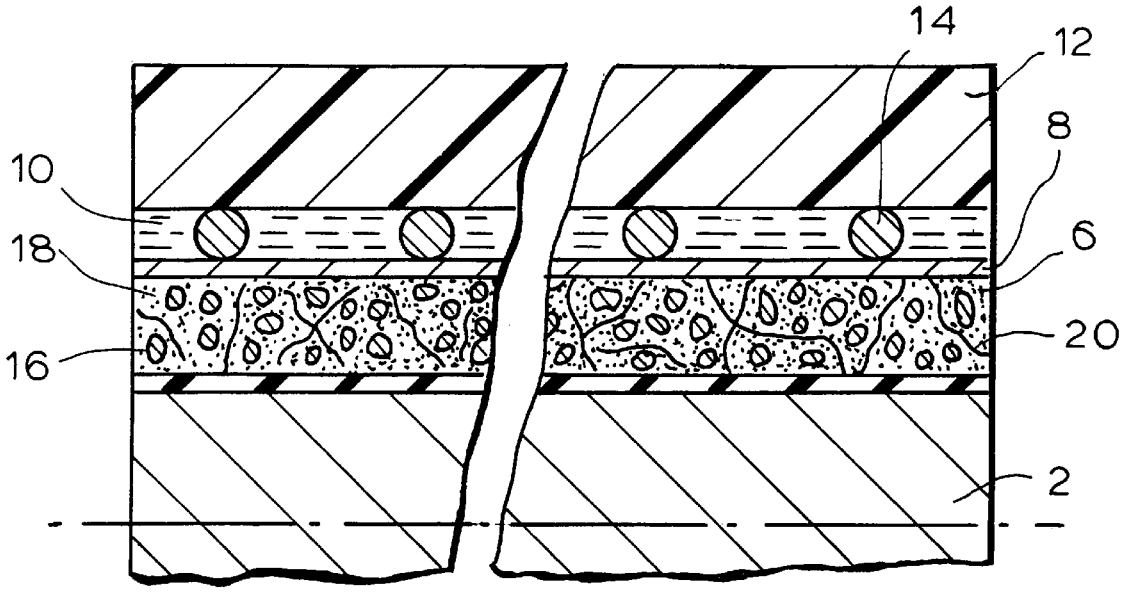
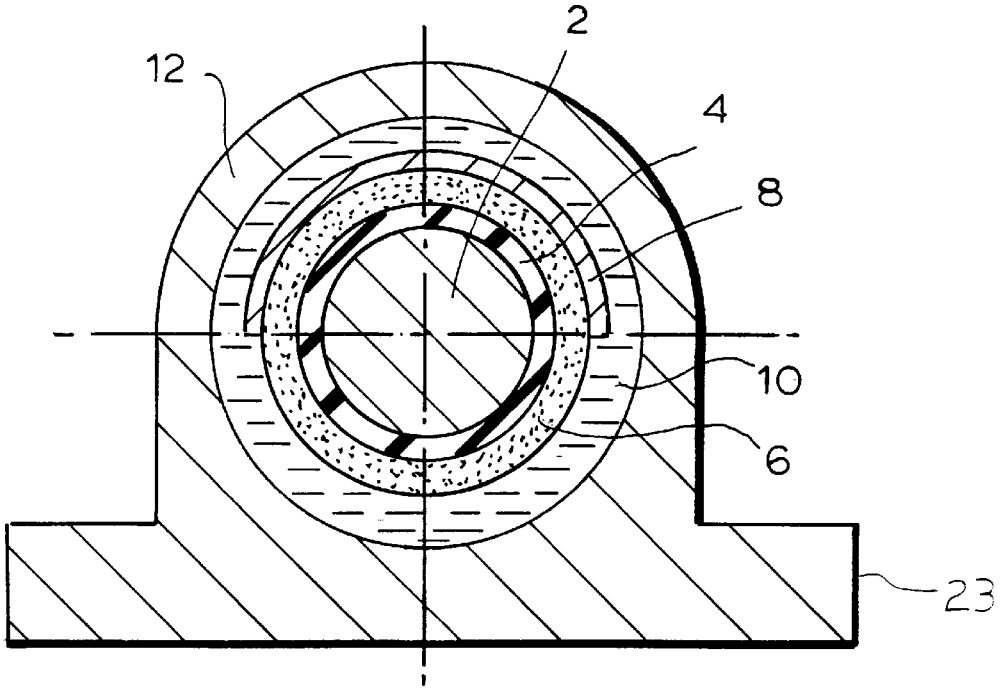
FIG. 5

FIG. 9
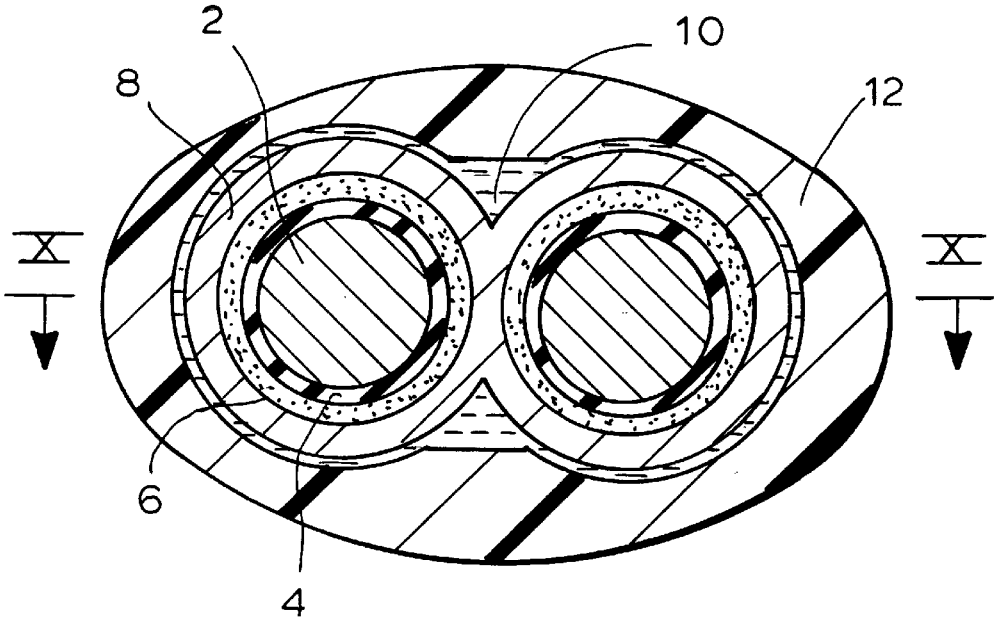
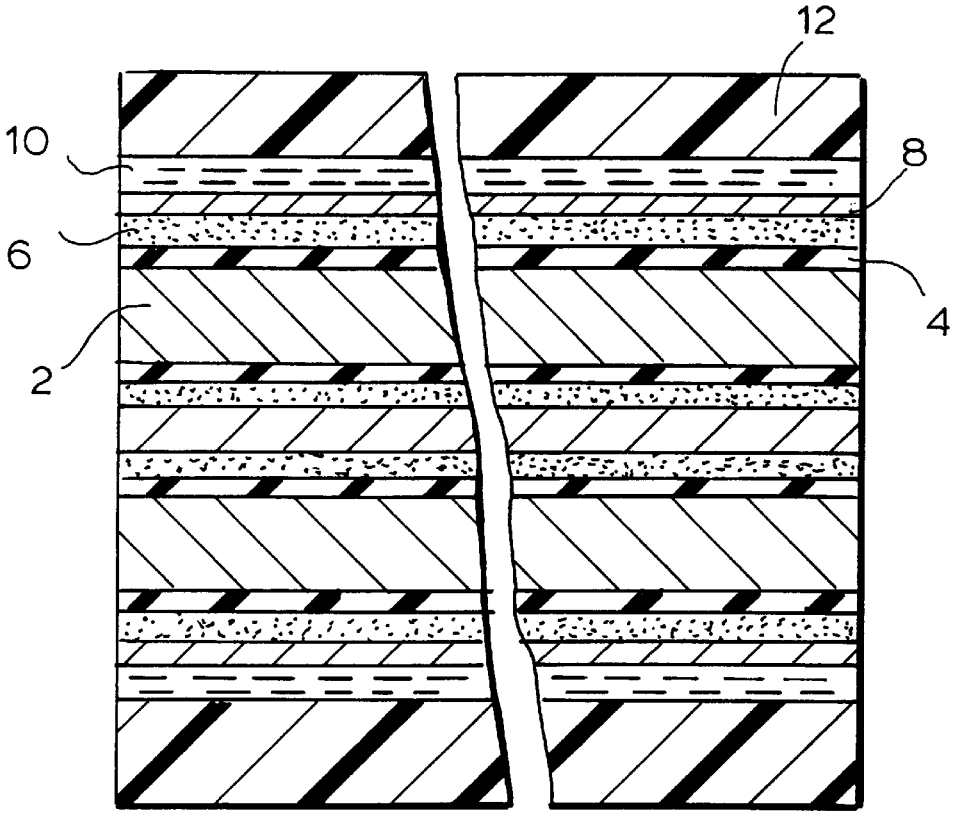
FIG. 10

FIG. 11
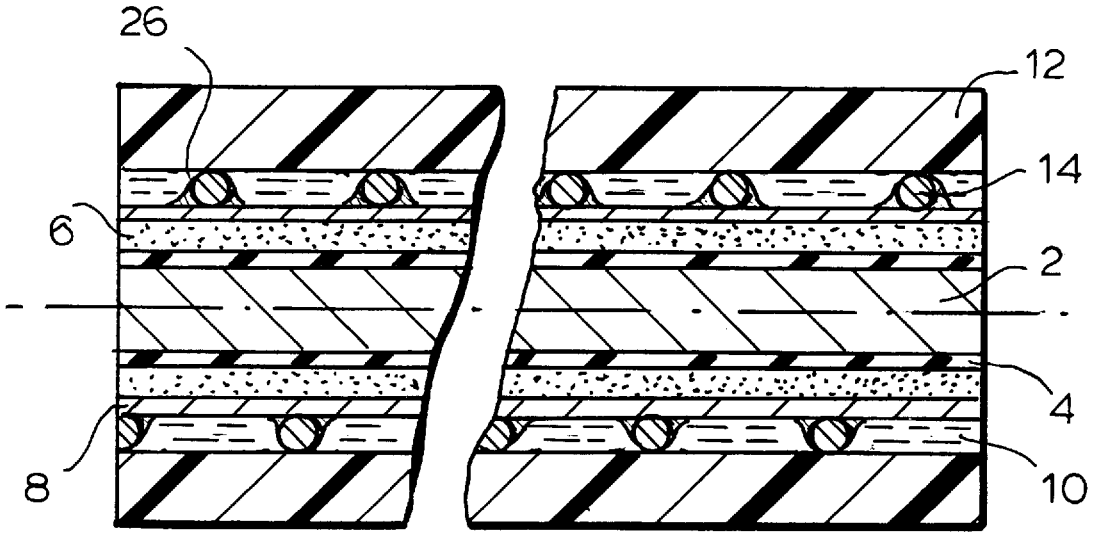
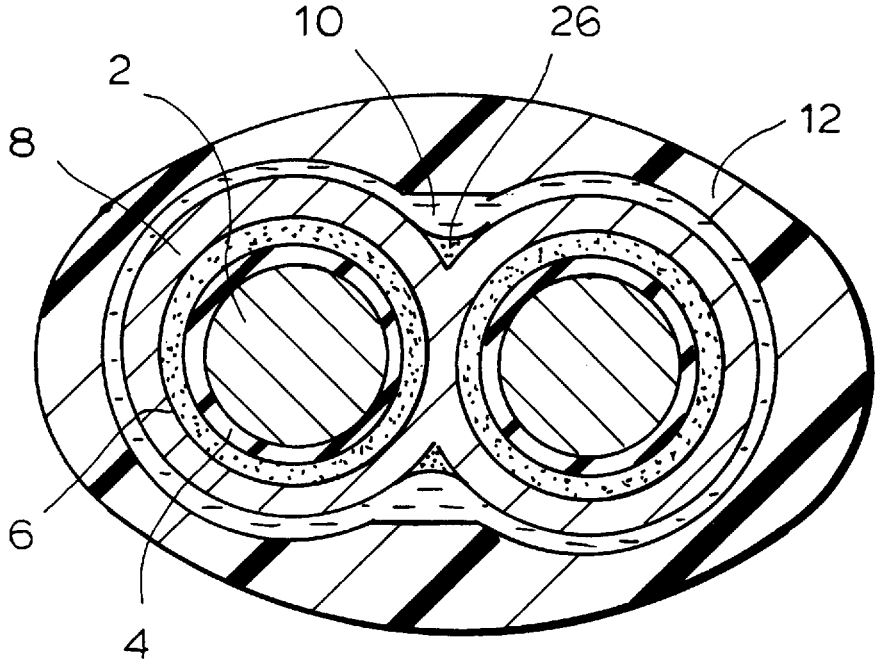
FIG. 12

ELECTROLUMINESCENT LIGHT SOURCE WITH A MIXTURE LAYER FILLED WITH A TRANSPARENT FILLER SUBSTANCE

TECHNICAL FIELD

The present invention relates to an electroluminescent (EL) light source. More particularly, it relates to a flexible, cable-like light source—an electroluminescent filament (ELF)—and to a method for producing same.

BACKGROUND ART

Such sources, in which an electroluminophor powder is located in an electric field created between two or more electrodes, are known. However, all of these devices suffer from a fundamental disadvantage which is inherent in the method of preparation of all cable-like EL sources: as the EL layer is applied to the cable core (whether conductive or insulating) by a continuous process of dip-coating, the EL particle/binder mixture must be a liquid of a fairly low viscosity, which is achieved by adding a suitable solvent. Yet once the EL layer is applied, this solvent, as is the way of solvents, evaporates and leaves behind a layer that is full of air-containing pores. These pores greatly reduce the electrical capacity of the EL sources and, thereby, their brightness.

A further drawback of the prior art EL sources resides in the fact that the above-mentioned air-filled pores constitute an optical discontinuity in the EL layer, causing further, substantial light losses due to total internal reflection at the binder/air interface, as well as through dispersion by the irregular wall surfaces of these air bubbles.

DISCLOSURE OF THE INVENTION

It is thus one of the objects of the present invention to overcome the drawbacks of the prior art and to provide a poreless ELF with a greatly increased electrical capacity and, all other parameters being the same, a substantially increased brightness.

According to the invention, this is achieved by providing a light source consisting of at least one flexible, cable-like electroluminescent filament, each filament comprising a central electrode surrounded by an electrically insulating dielectric layer; a layer consisting of a mixture of an electroluminophor powder and a binder, said mixture being applied to said dielectric layer; a transparent electrode surrounding the layer consisting of said mixture, wherein pores formed in said mixture layer are filled in by a transparent filler substance.

The invention further provides a method for preparing a light source, comprising the steps of covering a central electrode with an electrically insulating, dielectric layer; applying a mixture of an electroluminophor powder and a binder to said central electrode as covered by said dielectric layer; applying a transparent electrode to said mixture layer; impregnating said mixture layer, through said transparent electrode, with a filler substance to fill in pores in said mixture layer; covering said transparent electrode with a barrier layer to prevent said filler substance from seeping out of said filled-in pores or from evaporating therefrom, and covering said barrier layer with a layer of a flexible, transparent polymer.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 3 is a longitudinal cross-section, enlarged relative to FIGS. 1 and 2, which illustrates the detailed structure of the EL layer, including the pores.

FIG. 5 illustrates an embodiment of the ELF suitable for attachment to flat surfaces;

FIG. 9 is a cross-sectional view of an embodiment with two light-emitting filaments;

FIG. 10 is a longitudinal cross-section of the same embodiment along plane X—X of FIG. 9;

FIG. 11 shows an embodiment similar to the embodiment of FIG. 2, in which the electrical contact between the transparent electrode and the additional electrode has been enhanced by application of conductive droplets, and FIG. 12 illustrates a similar application of conductive droplets to the transparent electrodes of the embodiment of FIG. 9.

Figure 1:
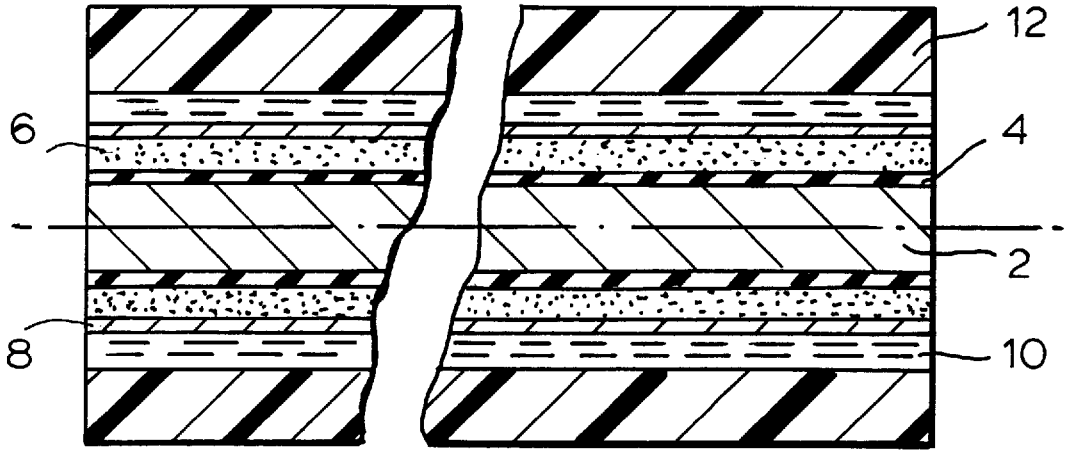
FIG. 1 is a longitudinal cross-section of a first embodiment of an ELF having two electrodes.

Referring now to the drawings, there is seen in FIG. 1 a first embodiment of an ELF comprising a flexible copper wire serving as an electrode 2, and covered by an electrically insulating dielectric layer 4 advantageously consisting of $BaTiO_3$ powder in a flexible binder on the basis of cyanoethyl starch. Layer 4 is preferably of a thickness of 10–15 $\mu$m. Surrounding this layer there is seen the electroluminophor layer 6 in a flexible binder on the basis of cyanoethyl starch. Layer 6, which preferably has a thickness of 30 to 100 $\mu$m, is surrounded by a thin, transparent electrode 8, e.g., a gold layer of a thickness of 200–400 Å. Conductive oxides or conductive polymers are also suitable. Layer 6, in its turn, is covered by a barrier layer 10 consisting of a transparent viscous substance, e.g., a silicon fluid or grease of a viscosity exceeding 1000 mPa sec. The purpose of barrier layer 10 will be explained further below. Layer 10 is surrounded by a transparent, flexible polymer layer 12, e.g., polyethylene or PVC, of a thickness of 0.3–1.2 mm.

The ELF emits light at the application of an alternating voltage within the range of 30–300 V between the electrodes 2 and 8, and having a frequency range of between 50 Hz and 20 kHz. Without any apparent damage, the ELF may be subjected to repeated bending (10–20 times) at a small bending radius of r=3 to 5 d, with d representing the diameter of the ELF, which is preferably about 1.6 mm, but may be smaller as well as larger.

Figure 2:
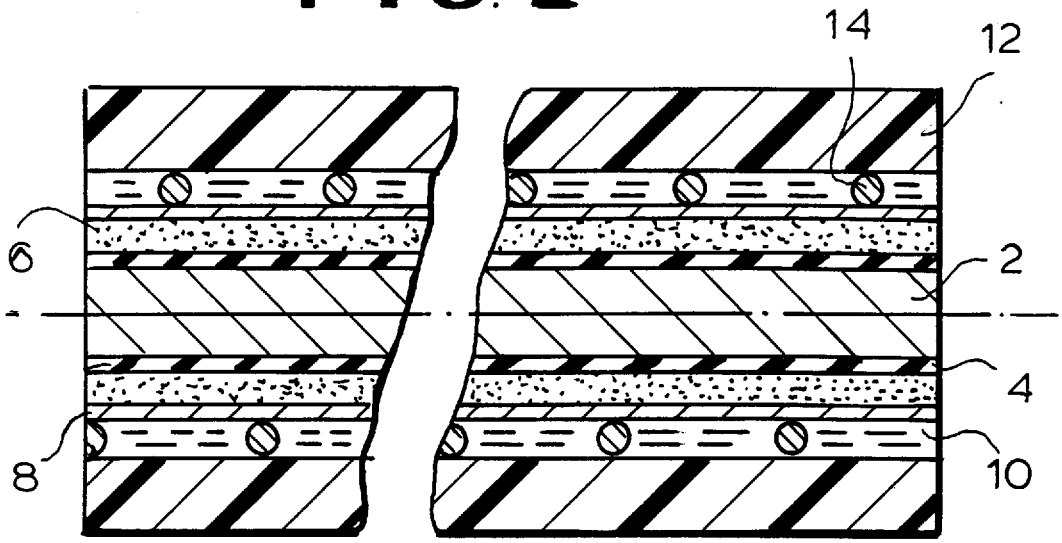
FIG. 2 represents a similar cross-section of another embodiment of an ELF which has an additional electrode.

The embodiment of FIG. 2 differs from that of FIG. 1 in that it possesses an additional electrode 14 in the form of a copper wire of a thickness of, e.g., 0.08 mm, helically wound around the surface of transparent electrode 8 to equalize the potential along the relatively high-resistance electrode 8 and to ensure continuous light emission along the entire ELF, even if the thin electrode 8 should break. The ELF of FIG. 2 emits light at the application of an appropriate AC voltage between electrodes 2 and 14.

FIG. 3, enlarged relative to FIGS. 1 and 2, shows the detailed structure of EL layer 6. As already mentioned above, to facilitate application of EL layer 6 by the simple process of dip-coating, the mixture of EL particles 16 and binder 18 (cyanoethyl starch or cyanoethyl cellulose with a dielectric constant of $\epsilon \approx 24$) is a liquid of fairly low viscosity, which is achieved by dissolving binder 18 in a suitable organic solvent, for instance, acetone or DMF. After this coat has been applied and dried, the solvent evaporates, leaving behind a layer 6 comprising EL particles 16 and binder 18, which is full of air-containing pores 20, the harmful effects of which have been dwelled upon earlier.

It should be noted, however, that the pores in layer 6 may have their origin in processes other than the evaporation of solvent, e.g., in certain mixing procedures.

Prior to the elimination of these pores, it has been found advantageous to apply the transparent electrode 8 on EL layer 6, preferably in the form of a transparent gold layer of a thickness of 200–400 Å, which is preferably done by a per se known sputtering process.

Pores 20 are eliminated at this stage by filling them in, using the capillary effect, with a filler liquid such as ethyl acetate which wets binder 18. This liquid is applied through electrode 8, which, considering its microscopic thickness, is not only transparent, but also liquid-permeable.

To prevent the filling liquid from seeping out of pores 20 or from evaporating, transparent electrode 8 is, in a subsequent stage, covered with barrier layer 10, consisting of a viscous, transparent, dielectric material which does not react chemically with layer 6 and the filler liquid. For instance, with cyanoethyl selected as binder 18, ethyl acetate may serve as filler substance and silicone oil of a viscosity exceeding 1000 mPa sec as barrier layer 10.

Thus, the brightness of an ELF impregnated with ethyl acetate and covered with a barrier layer 10 of silicone oil, is 15–20% higher than that of a non-impregnated ELF, other conditions and parameters being the same.

For best results, the index of refraction of barrier layer 10 should exceed the index of refraction of the external polymer 12, but should be lower than the index of refraction of transparent electrode 8.

It is also possible to use a filler substance that is of low viscosity and easily penetrates pores 20 when hot (at a temperature less than, or equal to, 200° C.) and sharply increases its viscosity, or even passes into the solid state when abruptly cooled and/or following special irradiation. (See also FIG. 4.) For instance, liquid methyl methacrylate containing methylic ether of benzoin as photoinitiator may be used to fill pores 20 at room temperature. After that, the system is irradiated with UV light of a wavelength of 254 nm. Methyl methacrylate photopolymerization leads to formation of polymethyl-methacrylate. The viscosity of the filler substance is sharply increased by several orders, so that the pores remain permanently filled.

If the filler substance is a highly viscous fluid or a solid, or if no filler is used at all, barrier layer 10, while not required for blocking liquid in the pores, is still necessary, since it plays several advantageous roles in increasing ELF reliability:

- At ELF bending, this layer prevents friction of the external polymer layer 12 against the thin, transparent electrode 8, thus mechanically protecting electrode 8.
- Barrier layer 10 may be hydrophobic, such as silicone oil, and serve as an additional barrier against water vapor penetration into the electroluminescent layer. It may be hydrophilic, such as glycerin or ethylene glycol, in this case playing the role of a dessicant. In both cases, barrier layer 10 increases ELF service life.
- Barrier layer 10 allows easy removal of external polymer layer 12 without damaging underlying layers, which is necessary when mating connectors to the ELF.

Figure 4:
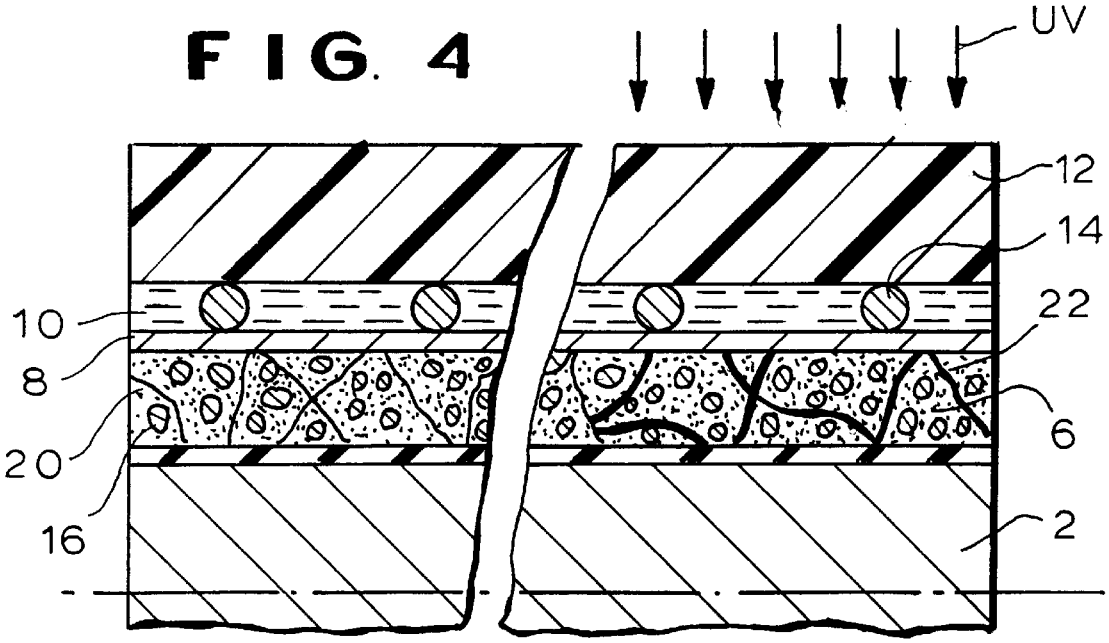
FIG. 4 shows, in its left half, the pores of FIG. 3 filled with a fluid monomer, and in the right half, the pores in which the monomer has been polymerized into its solid state by being exposed to UV radiation.

In its left half, FIG. 4 is identical to FIG. 3, but with pores 20 filled with a fluid monomer, while the right half of FIG. 4 shows that, exposed to UV radiation in a subsequent manufacturing step, the monomer is polymerized into its solid state, indicated by the heavy lines 22.

FIG. 5 illustrates an ELF construction specifically designed for attachment to flat surfaces. In this design, transparent electrode 8 is applied only on half of the ELF surface to prevent light emission from the back side (not visible to the consumer), thus reducing power consumption. The transparent, flexible polymer layer 12 has a special flat portion 23 which facilitates attachment to flat surfaces. Layers 4, 6 and 10 have the same function as layers with the same numbers in the other drawings.

Figure 6:
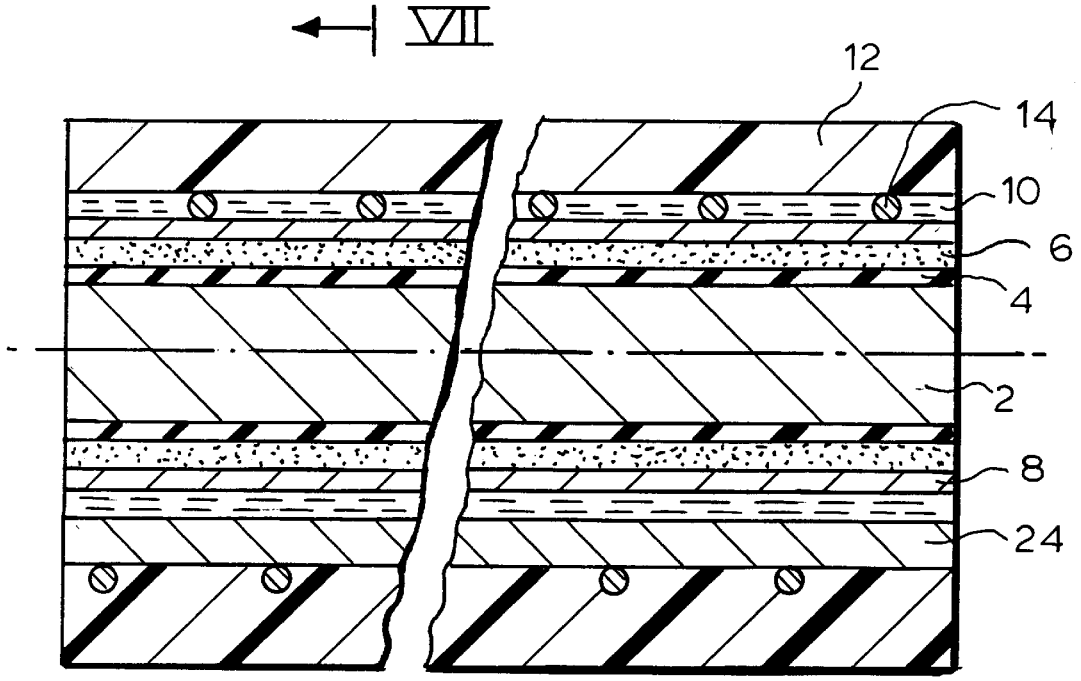
FIG. 6 is an embodiment which, further to the additional electrode of FIG. 2, is provided with a longitudinally disposed auxiliary electrode in conductive contact with the windings of the additional electrode.

FIG. 6 illustrates an embodiment which, in addition to the thin, helically wound wire electrode 14 of the embodiment of FIG. 2, is also provided with a longitudinally disposed, relatively heavy auxiliary electrode 24 which is in conductive contact with the windings of thin wire electrode 14. Due to the capability of electrode 24 to carry relatively heavy electrical currents, this design facilitates operation of ELFs of lengths of up to 100 m.

Figure 7:
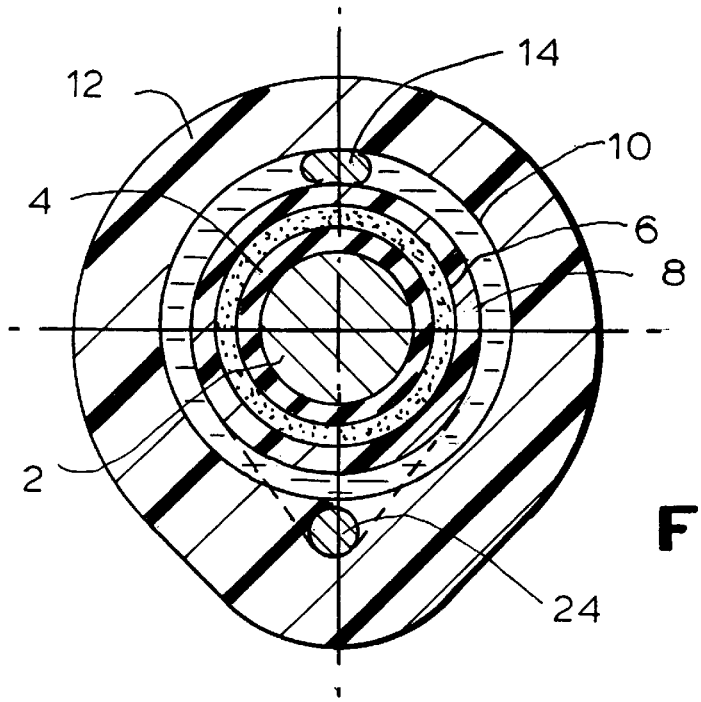
FIG. 7 is a view in cross-section along plane VII—VII of the ELF of FIG. 6.

FIG. 7 is a cross-sectional view of the ELF of FIG. 6, showing the pear-like shape of this embodiment.

Figure 8:
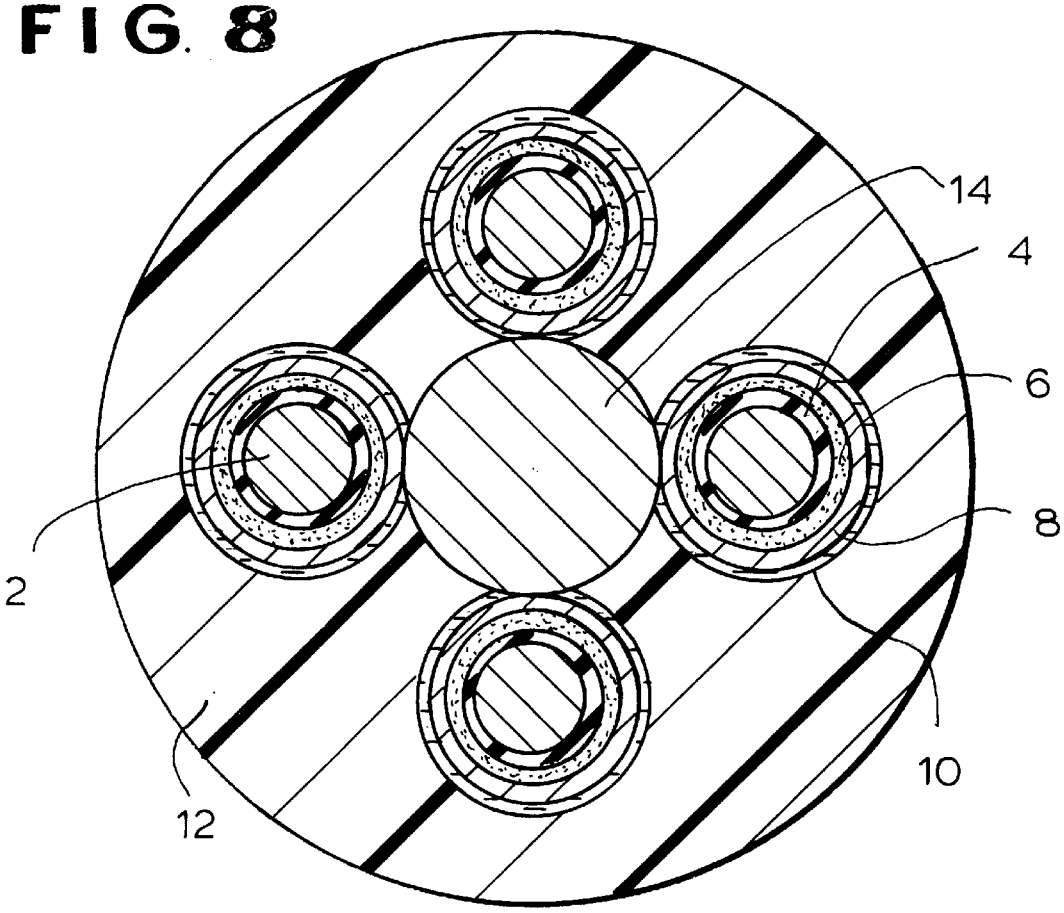
FIG. 8 illustrates a light-emitting filament with several electrodes.

The embodiment shown in FIG. 8 has several light-emitting filaments enclosed in the transparent, flexible polymer layer 12. This design is capable of a higher light output compared to the embodiment, say, of FIG. 2. Electrical potential to the transparent electrodes 8 of each of the light-emitting filaments is supplied by a common central electrode 14 which is in contact with the transparent electrodes 8 of the separate filaments. As electrode 14 does not screen off the light, it can have a relatively large diameter that permits operation of very long ELFs.

The embodiment of FIGS. 9 and 10 has two filaments touching each other with their transparent electrodes 8. Except for the area of the contact of layers 8, both filaments are covered by a barrier layer 10 and are enclosed together in polymer layer 12.

The electrical voltage is supplied between electrodes 2 of the filaments and to achieve a normal level of emission from each of the filaments, twice the voltage is required in this embodiment. The main advantage of the embodiment is the possibility of using very long continuous filaments (up to 300 m). Normally, the helically wound thin wire 14 (FIGS. 2 to 6) limits the electrical current that can be applied to the filament, thus limiting the length of a continuous filament. In this embodiment, the current flows through the much larger core electrodes 2.

In the embodiment of FIG. 11, droplets 26 of a conductive adhesive or a conductive ink are applied to additional electrode 14 during the winding thereof onto transparent electrode 8 at suitable distances from one droplet to the other (1 cm–20 cm). After the winding process, the conductive droplets, the purpose of which is to improve the long-term electrical contact between electrode 14 and electrode 8, are cured by moving the entire filament through an oven or exposing it to UV radiation.

A similar advantage is achieved by applying droplets 26 between transparent electrodes 8 in the embodiment of FIG. 12. After application of droplets 26, the filaments are mechanicallly pressed against each other and are subjected to a curing process.

The electroluminophor used is advantageously a commercially available zinc sulfide doped with copper and/or manganese in various proportions to produce the colours desired.

It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

We claim:

1. A light source consisting of at least one flexible, cable-like electroluminescent filament, each filament comprising:

a central electrode surrounded by an electrically insulating dielectric layer;

a layer consisting of a mixture of an electroluminophor powder and a binder, said mixture layer being disposed on said dielectric layer;

a transparent electrode surrounding said mixture layer, wherein pores formed in said mixture layer are filled in by a liquid solid transparent filler substance.

2. The light source as claimed in claim 1, further comprising at least one additional electrode helically wound over said transparent electrode and in electrical contact therewith.

3. The light source as claimed in claim 2, further comprising at least one additional, longitudinally extending electrode in electrical contact with said at least one helically wound electrode.

4. The light source as claimed in claim 2, wherein droplets of a conductive adhesive or a conductive ink are provided between said additional electrode and said transparent electrode.

5. The light source as claimed in claim 1, wherein said transparent filler substance is of low viscosity prior to the filling-in of said pores, but achieves high viscosity by treatment after the filling-in of said pores.

6. The light source as claimed in claim 1, wherein said transparent filler substance is a low-viscosity monomer prior to the filling-in of said pores, but turns into a solid polymer by treatment after the filling-in of said pores.

7. The light source as claimed in claim 1, wherein the index of refraction of said filler substance exceeds the index of refraction of said binder.

8. The light source as claimed in claim 1, wherein said source consists of a plurality of said electroluminescent filaments which surround, and are in electrical contact with, at least one common electrode.

9. The light source as claimed in claim 1, wherein said transparent electrode surrounds only part of the circumferential surface of said mixture layer.

10. The light source as claimed in claim 1, farther comprising a barrier layer consisting of a transparent substance disposed between said transparent electrode and an outer, flexible polymer layer, said transparent filler substance being permanently retained by said barrier layer.

11. The light source as claimed in claim 10, wherein said transparent barrier layer consists of a viscous substance.

12. The light source as claimed in claim 10, wherein said barrier layer is hydrophobic.

13. The light source as claimed in claim 10, wherein said barrier layer is hydrophilic.

14. The light source as claimed in claim 1, wherein said light source comprises two electroluminescent filaments and wherein said transparent electrodes surrounding each of said mixture layers are in electrical contact with one another.

15. The light source as claimed in claim 14, wherein said two electroluminescent filaments are covered by a common barrier layer.

16. The light source as claimed in claim 15, wherein both of said electroluminescent filaments as covered by said common barrier layer are enclosed in a common transparent, flexible, polymer layer.

17. The light source as claimed in claim 14, wherein droplets of a conductive adhesive or a conductive ink are provided between said transparent electrodes.

* * * * *